US010658767B2

(12) United States Patent
Koellmann et al.

(10) Patent No.: US 10,658,767 B2
(45) **Date of Patent: *May 19, 2020**

(54) CONDUCTOR CONNECTION CONTACT ELEMENT HAVING A POWER RAIL PIECE AND A CLAMPING SPRING FOR CLAMPING AN ELECTRICAL CONDUCTOR

(71) Applicant: WAGO Verwaltungsgesellschaft mbH, Minden (DE)

(72) Inventors: Hans-Josef Koellmann, Minden (DE); Henry Stolze, Bad Frankenhausen (DE)

(73) Assignee: WAGO Verwaltungsgellschaft mbH, Minden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/374,039

(22) Filed: Apr. 3, 2019

(65) Prior Publication Data

US 2019/0229441 A1 Jul. 25, 2019

Related U.S. Application Data

(60) Division of application No. 15/925,005, filed on Mar. 19, 2018, now Pat. No. 10,297,931, which is a (Continued)

(30) Foreign Application Priority Data

Sep. 18, 2015 (DE) ..... 10 2015 115 791

(51) Int. Cl.
*H01R 4/48* (2006.01)
*H01R 13/115* (2006.01)
(Continued)

(52) U.S. Cl.
CPC ..... *H01R 4/4836* (2013.01); *H01R 13/115* (2013.01); *H01R 12/515* (2013.01); *H01R 12/75* (2013.01); *H01R 43/16* (2013.01)

(58) Field of Classification Search
CPC .... H01R 4/4836; H01R 13/115; H01R 12/75; H01R 43/16
(Continued)

(56) References Cited

U.S. PATENT DOCUMENTS 6,024,612 A 2/2000 Myer et al.
6,050,862 A 4/2000 Ishii
(Continued)

FOREIGN PATENT DOCUMENTS

CN 101340024 A 1/2009
DE 10 2007 031 194 A1 1/2009
(Continued)

*Primary Examiner* — Harshad C Patel
(74) *Attorney, Agent, or Firm* — Muncy, Geissler, Olds & Lowe, P.C.

(57) ABSTRACT

A conductor connection contact element for clamping an electrical conductor, having a power rail piece and a clamping spring. The power rail piece is formed from a sheet-metal part with an oppositely situated second side wall, a base section and an oppositely situated cover section. The side walls, together with the base section and the cover section, border a conductor insertion channel. The clamping spring is arranged on the power rail piece. The clamping spring has an abutment section and a clamping section with a clamping edge for clamping the electrical conductor. The abutment section is arranged on the base section of the power rail piece. The freely movable end of the clamping section extends toward the cover section. An actuation section which is accessible to an actuation tool lies adjacent to the clamping edge in the direction of the side wall.

5 Claims, 12 Drawing Sheets

Related U.S. Application Data continuation of application No. PCT/EP2016/070831, filed on Sep. 5, 2016.

(51) Int. Cl.
*H01R 43/16* (2006.01)
*H01R 12/51* (2011.01)
*H01R 12/75* (2011.01)

(58) Field of Classification Search
USPC ..... 439/441, 849–858
See application file for complete search history.

(56) References Cited

U.S. PATENT DOCUMENTS

| | | | | |
|---|---|---|---|---|
| 7,229,328 | B2 | 6/2007 | Sawada et al. | |
| 7,351,118 | B1 | 4/2008 | Duesterhoeft et al. | |
| 7,507,107 | B2 | 3/2009 | Tuerschmann et al. | |
| 8,721,376 | B1 | 5/2014 | Bishop | |
| 9,276,331 | B2 | 3/2016 | Stadler et al. | |
| 2002/0076999 | A1* | 6/2002 | Chen | H01R 13/187 439/851 |
| 2005/0101198 | A1* | 5/2005 | Maeda | H01R 13/11 439/852 |
| 2008/0286996 | A1 | 11/2008 | Tuerschmann et al. | |
| 2015/0303594 | A1* | 10/2015 | Stadler | H01R 4/4836 439/729 |
| 2018/0254567 | A1 | 9/2018 | Stolze | |

FOREIGN PATENT DOCUMENTS

| | | | |
|---|---|---|---|
| DE | 20 2013 105 670 | U1 | 3/2014 |
| DE | 10 2013 111 649 | A1 | 5/2014 |
| DE | 20 2014 101 856 | U1 | 6/2014 |
| DE | 10 2014 108 965 | A1 | 12/2014 |
| DE | 20 2014 106 181 | U1 | 3/2015 |
| DE | 10 2014 200 271 | A1 | 7/2015 |
| EP | 1 881 560 | A1 | 1/2008 |
| EP | 2 854 226 | A1 | 4/2015 |
| GB | 2516555 | A | 1/2015 |
| TW | I 355780 | B | 1/2012 |
| WO | WO 2014/124475 | A2 | 8/2014 |

* cited by examiner

CONDUCTOR CONNECTION CONTACT ELEMENT HAVING A POWER RAIL PIECE AND A CLAMPING SPRING FOR CLAMPING AN ELECTRICAL CONDUCTOR

This nonprovisional application is a Divisional of U.S. application Ser. No. 15/925,005, which was filed on Mar. 19, 2018, which is a continuation of International Application No. PCT/EP2016/070831, which was filed on Sep. 5, 2016, and which claims priority to German Patent Application No. 10 2015 115 791.8, which was filed in Germany on Sep. 18, 2015, and which are all herein incorporated by reference.

BACKGROUND OF THE INVENTION

Field of the Invention

The present invention relates to a conductor connection contact element for clamping an electrical conductor with a power rail piece, which includes a sheet metal part with a first side wall and a second side wall situated opposite the first side wall, a base section extending from the first side wall to the opposite second side wall, and a cover section situated opposite the base section and extending from the first side wall to the opposite second side wall, wherein the side wads with the base section and the cover section border a conductor insertion channel, and having a clamping spring disposed on the power rail piece, which has a clamping section with a clamping edge for clamping the electrical conductor at a first end region of an abutment section and at the second end region, which is situated opposite the first end region. The abutment section is disposed on the base section of the power rail piece. The freely moveable end of the clamping section extends toward the cover section.

Description of the Background Art

Conductor connection contact elements are used in a variety of ways. The conductor connection contact element is primarily intended and designed to be placed directly on a printed circuit board and be soldered to the circuit board in order to provide a PCB contact for clamping an electrical conductor by means of spring-force clamping connection. The conductor connection contact element is provided for use without bordering insulating material.

DE 20 2013 105 670 U1 shows a connection for light emitting diodes, having an insulating housing provided with pushbuttons and a plurality of conductive contact units located in the insulating housing. The contact units are composed of two metal strips. The first metal strip has an upwardly raised metal wall which is curved inward on the upper side to form a semi-circle. The second metal strip is connected at its one end to the upper end of the first metal strip, and is provided at its other end with two branch tongues. One of the branch tongues is provided for clamping the electrical conductor. The other branch tongue is aligned with the pushbutton such that the pushbutton can be pressed against the second metal strip to open the clamping point position for clamping an electrical conductor that is formed by the first branch tongue and the first metal strip.

DE 20 2014 101 856 U1 discloses a quick connection terminal comprising a conductive copper web and a flexible conductive steel sheet, which is attached to the copper web. For this purpose, holding plates, on which the steel sheet is supported and that are situated opposite to each other, are bent off from the copper web. Between the clamping section of the steel sheet for clamping an electrical conductor and the base section of the copper web, a guide web is bent off from the holding plates, obliquely pointing into the conductor insertion channel in order to guide an electrical conductor that is to be clamped from the left and right side toward the clamping jaw, which is formed by the clamping plate and the copper web.

WO 2014/124475 A2 discloses a connecting or terminal clamp for electrically connecting at least one conductor, and having an electrical contact body. The connecting clamp has an insulating housing, in which the contact body is arranged. The contact body has a stamped part with an opening, and a spring element disposed in the opening. The spring element is designed as a U-shaped curved leg spring with an abutment section, a subsequent resilient bend, and a clamping leg situated opposite the abutment section and adjacent to the resilient bend. The abutment leg rests on a base section of the stamped part. The clamping leg is aligned toward the cover section of the stamped part in order to form a clamping point for clamping an electrical conductor. To open the clamping point, an actuation tool can be fitted through an opening in the insulating housing on the clamping leg in order to move said leg away from the cover section of the stamped part.

SUMMARY OF THE INVENTION

It is therefore an object of the present invention to provide an improved conductor connection contact element for clamping an electrical conductor.

In an exemplary embodiment, a conductor connection contact element is provided having a power rail piece and a clamping spring, as viewed transversely with respect to the longitudinal extension direction of the clamping section, and an actuation section, which is accessible to an actuation tool, provided adjacent to the clamping edge. A conductor guide region adjoining the clamping section is formed on the first side wall. The conductor guide region is a section of the first side wall oriented obliquely in the direction of the oppositely situated second side wall.

The conductor connection contact element is formed with the aid of the actuation section on the clamping section such that the clamping point for clamping an electrical conductor can be opened by application of force to the actuation section by means of an actuation tool. In this case, the clamping edge of the clamping section, which adjoins the actuation section, moves away from the cover section of the power rail piece. With the help of the conductor guide region oriented obliquely on the first side wall toward the oppositely situated second side wall, an electric conductor is moved toward the clamping edge, thereby preventing that conductors as a whole, or possibly strands of a fine-wire electrical conductor, infiltrate the area of the actuation section.

By means of this conductor guide region on the first side wall, a section of the side wall is thus provided for guiding an electrical conductor that is to be clamped toward the clamping edge. This conductor guide region of the first side wall also covers the actuation section of the clamping spring, which has adjacently arranged clamping and actuation sections, as viewed in the conductor insertion direction. Thus, a very compact and reliable conductor connection contact element is created, of which the clamping point can be moved with an actuation tool toward the base section to open the clamping point.

The actuation section may have an actuation tab protruding laterally from the first side wall. The actuation section may also have a further actuation tab on the opposite side, likewise laterally protruding from the clamping section.

By means of the actuation tab protruding from the side wall, an actuation tool can be applied to the conductor connection contact element. For this, the actuation tool is placed on the actuation tab and a force for opening the clamping point is applied to the actuation tab. In this case, the actuation tool can be, for example, a screwdriver, a user's finger, etc.

On the first side wall, the conductor connection contact element can have an opening for the passage of the actuation tab. The conductor guide region is thereby oriented pointing away from the opening-bordering end edge of the first side wall which is situated opposite the conductor guide region. This prevents an electrical conductor, which is inserted into the conductor insertion channel and is to be clamped, from abutting as a whole or with its strands against the end edge of the first side wall that is exposed by the opening. The conductor guide region thus keeps the opening with the end edges, which border the opening, free from an inserted electrical conductor that is to be clamped.

The conductor guide region may be formed as a material tongue of the first side wall which is obliquely oriented in the direction of the second side wall and toward the clamping section. The material tongue is not connected to the base section and the cover section. Rather, the material tongue is separate from the base section and the cover section. The material tongue can in this case be disposed in the gap between the cover section and the clamping section so that the clamping spring is positioned between the base section and the material tongue. Thus, a space for the clamping spring is provided between the base section and the cover section, which is partially closed with the at least one material tongue in order to provide a conductor guide.

The actuation section may have an actuation tab extending in the direction of the plane of the cover section. This actuation tab is then positioned offset next to the clamping edge in the direction of extension of the clamping section. Thus, the point of attack for actuating is displaced towards the upper side on the cover section of the conductor connection contact element.

In an embodiment, the actuation section can have an actuation tab which is disposed laterally in an opening in the first side wall, which, as viewed in the conductor insertion direction, and is arranged behind the free end of the material tongue and is accessible from the outside.

At the back end of the power rail piece, which is opposite the conductor insertion channel, an end stop can be formed by a material tongue bent off from a side wall, from the base section or from the cover section. This allows in a very simple manner for the sheet metal part of the power rail piece to be reshaped such that a conductor collecting pocket is formed.

In an embodiment, material tongues oriented towards one another can be bent from both walls in order to form an end stop.

The abutment section may be clamped between the side walls and the base section. This way, the clamping spring can be clamped easily to the power rail piece and fixed in position there.

The abutment section can be fixed in position to the power rail piece with a fixing section protruding from the abutment section into an opening of the base section, or with a fixing section protruding from the base section into an opening of the abutment section. The fixing section can be a tab or an embossment or the like. This way, a shifting of the clamping spring after hooking the clamping spring into the power rail piece can be easily prevented.

The clamping spring may have a resilient bend connecting the abutment section to the clamping section, for example, being formed as a U-shaped, curved leg spring. From at least one side wall, as viewed in the conductor insertion direction, a conductor guide plane is then bent in front of the resilient bend toward the oppositely situated side wall. In this case, this conductor guide plane is situated before the resilient bend, as viewed in the conductor insertion direction, and serves to guide an electrical conductor past the resilient bend toward the clamping section. For this purpose, the conductor guide plane is oriented pointing obliquely in the conductor insertion direction toward the cover section. This conductor guide plane can be easily created from the sheet metal part by bending a section from the side wall.

The cover section or the base section can have a solder connection area. This solder connection area can, for example, be formed as a solder connection lug that is separate from the cover section or the base section. Parts of the cover section or the base section can themselves be used for soldering to a printed circuit board.

An overload stop tab, which extends in the direction of the oppositely situated side wall and is positioned in the space between the clamping section and the base section, may project from a side wall. Such a tab can also be easily shaped out of the sheet metal part by said tab being bent over in a section of the side wall that forms a lateral opening which is pointing into the interior of the cage-shaped conductor connection contact element.

A generic conductor connection contact element may also be formed by the clamping spring having an actuation section and by the actuation section being formed as an actuation tab that is fitted laterally from the clamping section of the clamping spring and laterally projects from the first side wall.

With such a cage-like conductor connection contact element, thus, a very simple and compact design is achieved with an opening of a clamping point for clamping an electrical conductor, which is possible by using an actuation tool or the finger of a user, in that an actuation tab laterally projects from the first side wall of the power rail piece.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
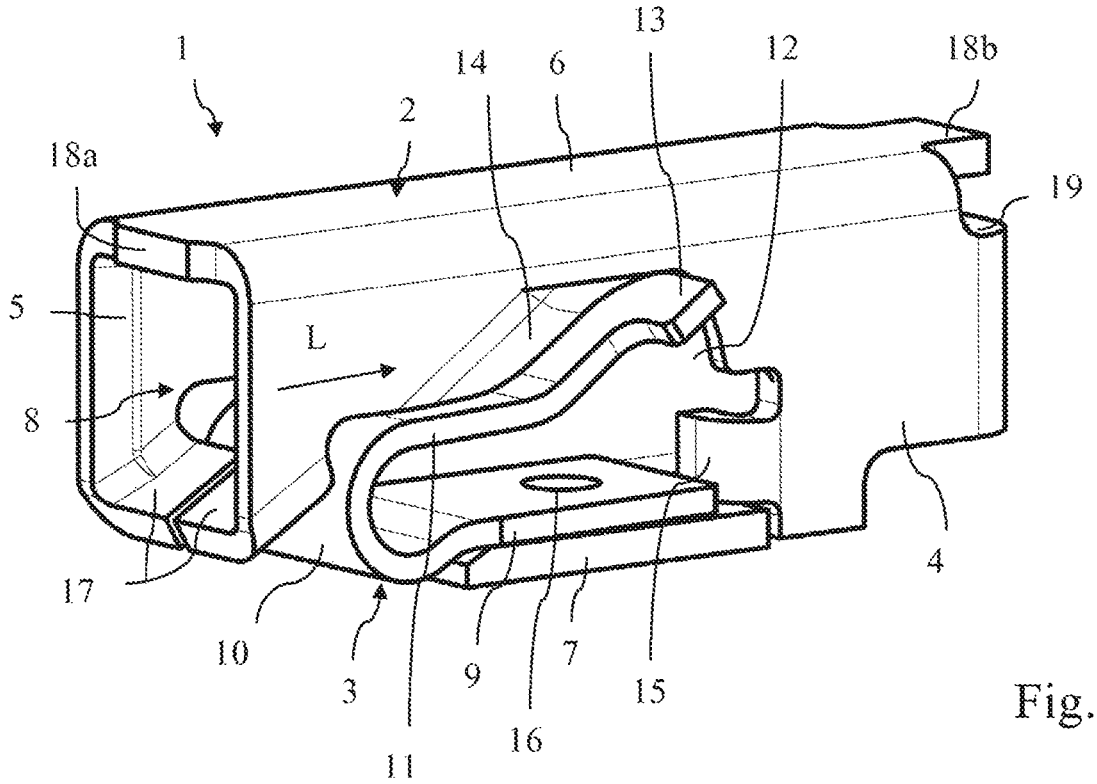
FIG. 1 is a perspective view of an embodiment of a conductor connection contact element.

FIG. 1 shows a perspective view of a first embodiment of a conductor connection contact element 1, which is formed of a power rail piece 2 and a clamping spring 3 inserted therein. The power rail piece 2 is formed of a cage-shaped sheet metal part. It has a first side wall 4 and an oppositely situated second side wall 5. These two side walls 4 and 5 are connected to each other by a cover section 6. In the illustrated embodiment, the cover section 6 is integrally molded with the two side walls 4 and 5 extending as bent portions from said walls.

Opposite the cover section 6, the power rail piece 2 has a base section 7, which also extends from the first side wall 4 to the second side wall 5. The base section 7 is formed by folding the second side wall 5 and abuts the first side wall 4. It is thus not firmly bonded with the first side wall 4.

A conductor insertion channel 8, which is provided for inserting and guiding an electrical conductor as well as for receiving the clamping spring 3, is bordered by the first and second side walls 4 and 5, which are spaced apart from each other, as well as by the cover and base sections 6 and 7, which extend transversely thereto and are also spaced apart from each other.

The clamping spring 3 is embodied as a U-shaped, curved leg spring with an abutment section 9 that is supported on the base section 7, a subsequent resilient bend 10, and a clamping section 11 extending in the conductor insertion direction L, i.e., in the direction of the conductor insertion channel 8 or obliquely into said conductor insertion channel 8. The clamping section 11 extends with its freely movable end toward the cover section 6.

It is apparent that the first side wall 4 has an opening 12 for the passage of an actuation tab 13, which laterally projects from the clamping section 11. By exerting an actuating force on the actuation tab 13, the clamping section 11 can be shifted against the spring force of the clamping spring 3 in the direction of the abutment section 9. Thus, a clamping point for clamping an electrical conductor is opened between a clamping edge of the clamping section 11 and the power rail piece 2.

The actuation tab 13 forming an actuation section is disposed alongside said clamping edge, as viewed transverse to the longitudinal extension direction of the clamping section 11. A conductor guide region 14, which is formed on the first side wall 4, adjoins the clamping section which is located in the interior of the power rail piece 2 and therefore not visible. For this purpose, a section of the first side wall 4, situated between the insertion area and the clamping section and actuation section, is oriented obliquely in the direction of the oppositely situated second side wall 5 and toward the clamping section 11. An electrical conductor inserted into the conductor insertion channel 8 is guided to the clamping edge with the aid of the conductor guide region 14, and this conductor or the strands of a fine-wire conductor are prevented from reaching the actuation section and possibly exiting from the power rail piece 2 through the opening 12 in the area of the actuation tab 13.

It is also clear that an overload stop tab 15, which forms an end stop for the clamping section 11 and faces the second side wall 5, is provided on the first side wall 4. The clamping section can only be depressed so far in the direction of the abutment section 9 until it strikes the overload stop tab 15.

By means of this overload stop tab 15, the clamping spring 3 is also fixed in position on the power rail piece 2. This positional fixing is also achieved by a depression or an opening 16 in the abutment section 6, into which an embossment of the base section 7 is inserted. Optionally, the abutment section 9 can also be welded, riveted, or screwed to the base section 7, or fastened in some other way. It is also conceivable that a fixing section, for example, in the form of a flap, is shouldered from the abutment portion 9, said fixing section projecting into an opening of the base section 7.

It is further apparent that in the embodiment shown, conductor guide planes 17 are bent off from the two side walls 4 and 5, in the region immediately in front of the resilient bend 10. These conductor-guide-forming sheet metal parts of the power rail piece 2 are aligned obliquely facing the cover section 6 in the conductor insertion direction L. Thus, a funnel-shaped conductor insertion channel 8 is provided, in which an electric conductor is guided at least in the lower region alongside the resilient bend 10 to the inclined plane of the clamping section 11.

As an alternative to this illustrated embodiment of the conductor guide planes 17 bent off from both side walls 4 and 5, it is also conceivable that the conductor guide plane 17 is formed, for example, only of one sheet metal part that is bent off from a side wall 4 or 5, which then abuts the opposite side wall and extends up to said side wall.

Furthermore, it is clear that the cover section 6 has narrower tabs 18*a*, 18*b* at the opposite end regions, which are separate from the cover section 6 and are used to connect the power rail piece 2 during manufacturing in the production tool. The soldering of the contact on the circuit board is carried out on the underside of the base section 7. The upper side of the cover section 6 is needed as a flat suction surface for automatic circuit board assembly with a suction gripper. The conductor connection contact element 1 can potentially also be placed with the cover section 6 on a printed circuit board and soldered in place to circuit traces on the circuit board with the tabs 18*a*, 18*b*. In that case, the tabs 18*a*, 18*b* form solder connection areas.

It is further noticeable that at the back end of the power rail piece 2, which is situated opposite the conductor insertion channel 8, an end stop 19 is formed by a material tongue being bent off from at least one of the side walls 4, 5. It is clear that a material tongue is bent off from the first side wall 4 toward the oppositely situated second side wall 5 in order to form the end stop 19.

Figure 2:
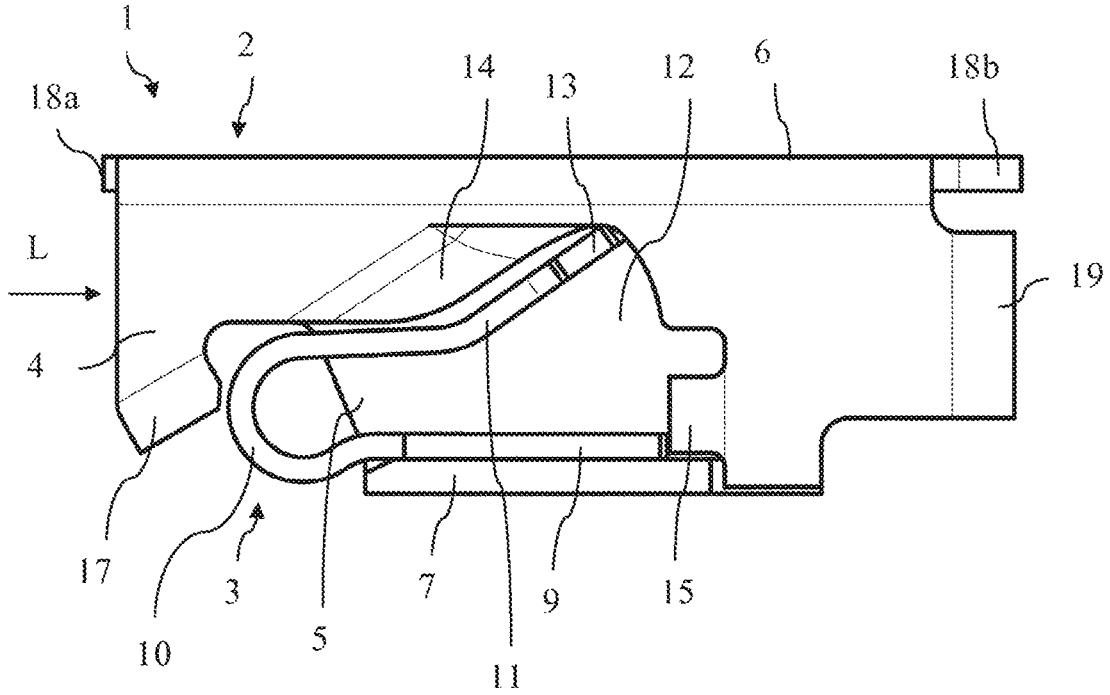
FIG. 2 is a side view of the conductor connection contact element from FIG. 1.

FIG. 2 reveals a side view of the conductor connection contact element 1 from FIG. 1. It is clear that the overload stop tab 15 immediately adjoins the abutment section 9. This prevents movement of the clamping spring 3 in the conductor insertion direction L.

It is also apparent that the conductor guide plane 17, as viewed in the conductor insertion direction L, is situated in front of the resilient bend 10 and oriented obliquely such that the conductor guide plane 17 indicated by the kink fold is continued approximately above the transition between the resilient bend 10 and the adjoining clamping section 11. An electrical conductor is thus securely guided to the plane of the clamping section 11, without abutting the resilient bend 10. The conductor guide region 14 formed on the first side wall 4 extends at a distance therefrom. Said guide region is reshaped from the first side wall 4 towards the oppositely situated second side wall 5. It is cohesively connected to the first side wall 4 and can be cut free in partial areas, for example in the upper section of the first side wall 4.

It is also clear that the actuation tab 13 provided on the actuation section protrudes laterally from the opening 12 and that the opening 12 thereby allows for unhindered movement of the clamping section 11 toward the abutment section 9 for opening the clamping point. The overload stop tab 15 also does not hinder the actuation tab 13. Rather, the overload stop is provided by the area adjoining the actuation tab with the clamping edge.

Figure 3:
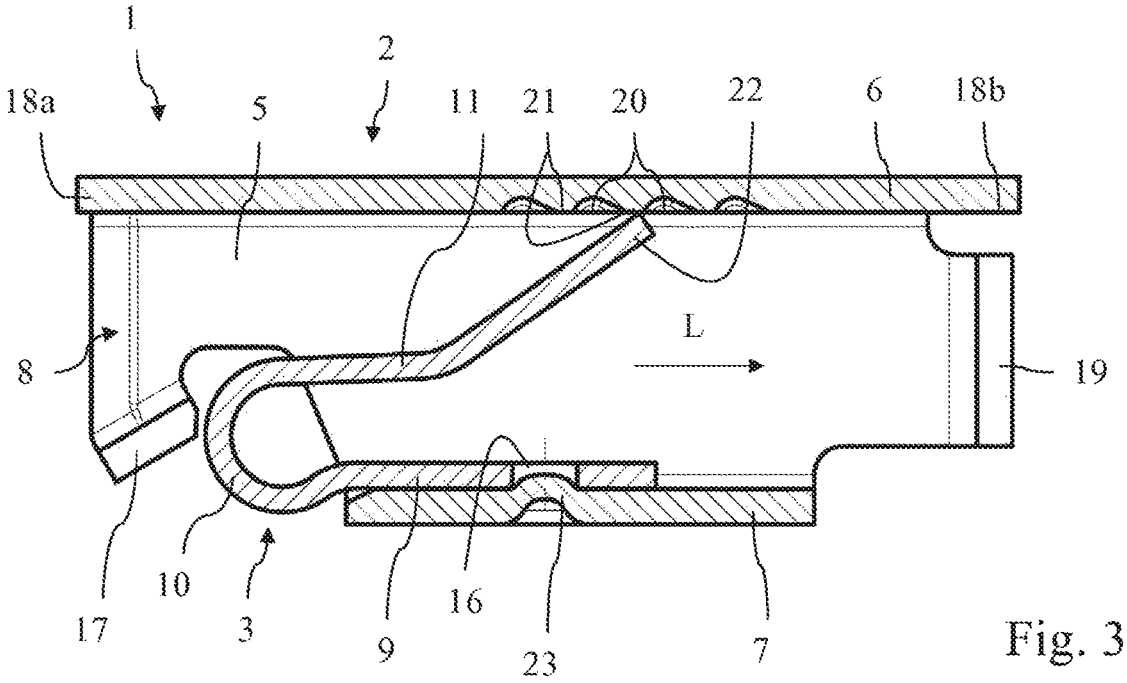
FIG. 3 is a side sectional view through the connection conductor contact element from FIG. 2.

FIG. 3 shows a side sectional view of the conductor connection contact element 1 from FIG. 2. Here, it is clear that the inside of the cover section 6 has embossments 20 with which clamping projections 21 are formed. It can further be seen that the clamping section 11 has a clamping edge 22 at its freely movable end, which in the illustrated rest state without the inserted electrical conductor abuts the inner side of the cover section 6. It ends, for example, at such a clamping projection 21. An electrical conductor, which is inserted and clamped between the clamping edge 22 and the clamping projection 21, is thus clamped under optimum surface pressure and reduced transition resistance on the power rail piece 2 by the clamping force of the clamping spring 3. The clamping force of the clamping spring 3 is in this case focused on the reduced area of the clamping projection 21 so that the force (surface pressure) acting per unit area is increased.

It is further apparent that on the opposite side, the abutment section 9 is supported on the base section 7. A position fixing takes place in that in the base section, an embossment 23 is inserted into the opening 16 of the abutment section 9. Thus, shifting of the clamping spring 3 in the conductor insertion direction L is prevented. Moreover, the clamping spring 3 abuts the second side wall 5 with the abutment section 9 and the clamping section 11 so that an inclined position of the clamping spring 3 is prevented.

Further, the inclined conductor guide plane 17 leading past an electrical conductor on the subsequent resilient bend 10 in the front face side open area of the conductor insertion channel 8, as well as the end stop 19, are visible at the opposite end of the power rail piece 12. It is also clear that the resilient bend 10 is offset outwards (in the figure, downwards) with respect to the inside of the base section 7 and is thus arranged in an area between the planar section of the base section 7 and the conductor guide plane 17.

Figure 4:
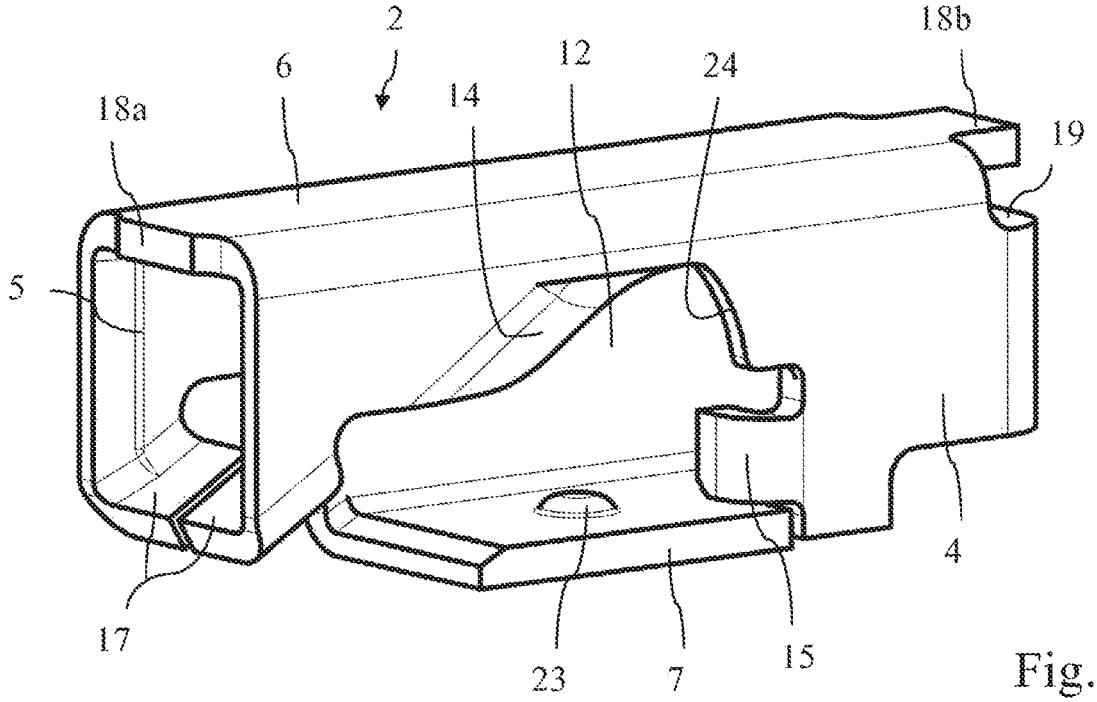
FIG. 4 is a perspective view of the power rail piece of the conductor connection contact element from FIG. 1.

FIG. 4 reveals a perspective view of the power rail piece 2 without the clamping spring. Here, the embossment 23 on the base section 7 becomes clear. Said embossment is configured as a partially circular elevation.

It can further be seen that the opening 12, as viewed in the conductor insertion direction L, is bordered by an end edge 24 which is located above the overload stop tab 15. In order to keep an electrical conductor out of the opening 12 and to prevent abutting said end edge 24, the conductor guide region 14 is formed upstream of the end edge 24 as a section of the first side wall which is obliquely oriented to the second side wall 5.

The conductor guide region 14 is thus oriented facing away from the end edge 24, which borders the opening 12, of the first side wall 4, which sits opposite the conductor guide region 14.

Figure 5:
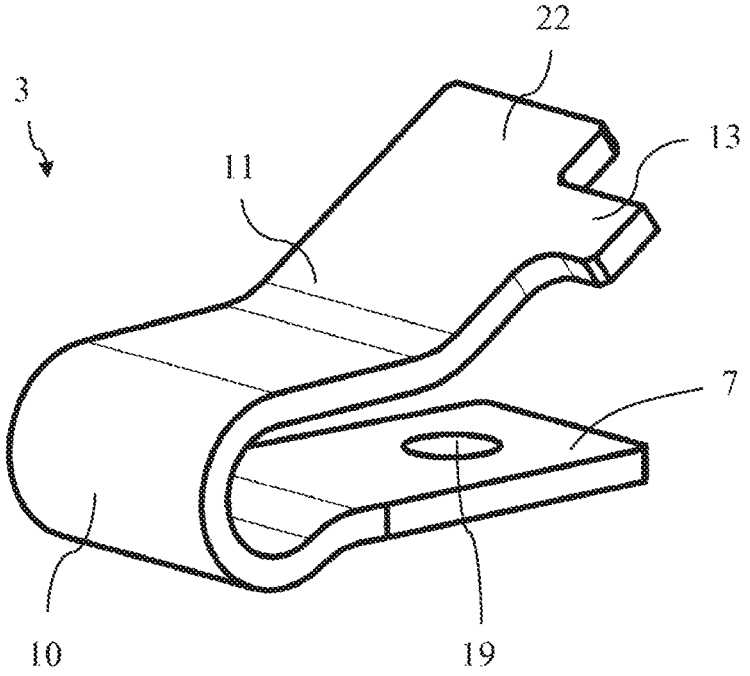
FIG. 5 is a perspective view of the clamping spring of the conductor connection contact element from FIGS. 1 to 3.

FIG. 5 reveals a perspective view of the clamping spring 3 for the conductor connection contact element 1 from FIGS. 1 to 3. It is clear that the clamping section 11 has a clamping edge 22 over a substantial part of its width, said clamping section being laterally adjoined by an actuation section with a laterally projecting actuation tab 13. Thus, the actuation section with the actuation tab 13 is positioned next to the area of the clamping edge 22, i.e., on the side edge of the clamping section 11, as viewed transversely to the longitudinal extension direction of the clamping section 11.

Figure 6:
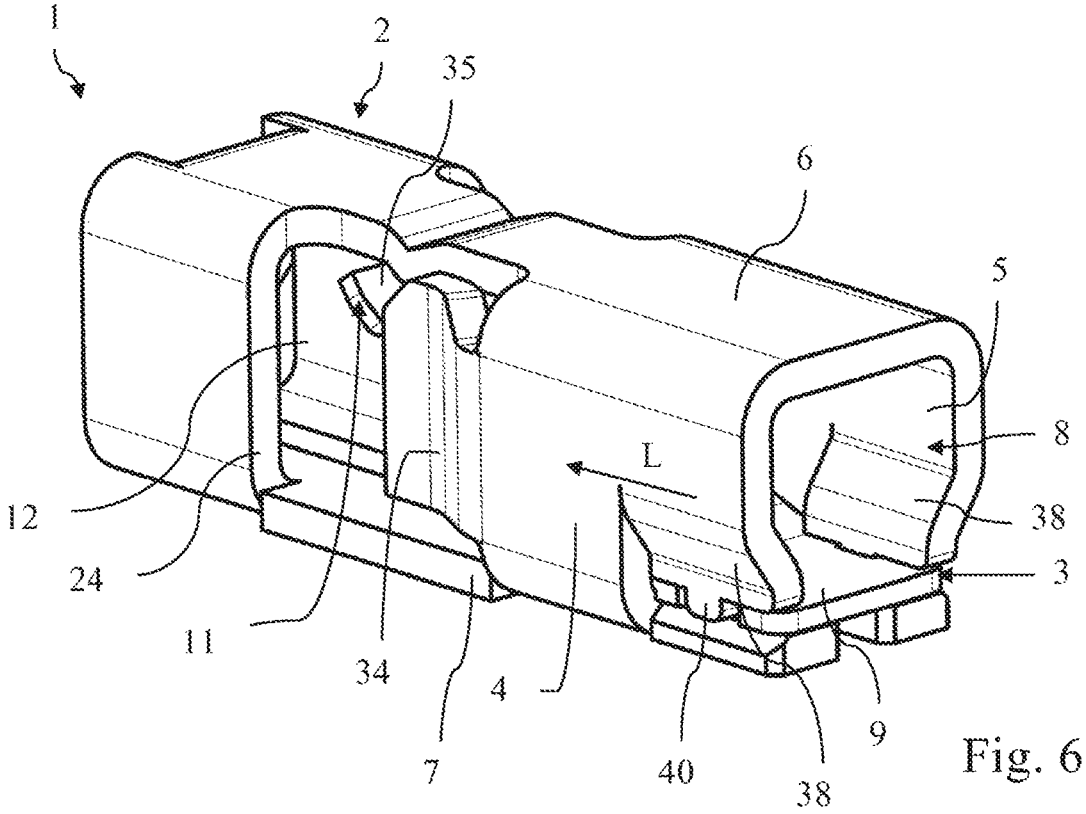
FIG. 6 is a perspective view of an embodiment of a conductor connection contact element.

FIG. 6 reveals a perspective view of a second embodiment of a conductor connection contact element 1. The conductor connection contact element 1 is again formed from a power rail piece 2 and a clamping spring 3. The clamping spring 3 is formed as a leaf spring extending from a base section 7 to the opposite cover section 6. This leaf spring rests with its abutment section 9 on the base section 7 in the entry-side section of the conductor guide region 14. An electrical conductor is inserted from this front side into the, again, cage-shaped power rail piece 2.

For this purpose, in turn two mutually opposed and spaced-apart side walls 4 and 5 are bent off from a sheet metal part of the cover section 6, to which the base section 7 is connected, which extends transversely between the side wall sections 4 and 5 and is spaced apart from the cover section 6.

It is clear that the contact leg 9 of the clamping spring 3 is clamped between the end edges of the two side walls 4 and 5 and the base section 7.

As viewed in the conductor insertion direction L, conductor guide regions 34 are provided at least on the first side wall 4, and in the illustrated embodiment, on both side walls 4 and 5. These conductor guide regions 34 are formed as material tongues, which cohesively adjoin the respective side wall 4, 5 and are obliquely oriented toward the respective opposite side wall 5, 4 and aligned to a clamping section, i.e., the freely movable end of the clamping section 11 of the clamping spring 3. The material tongues are formed from the side wall 4 in that the end faces of the material tongues facing the base section 7 and the cover section 6 are separate from the adjacent base section 7 or cover section 6.

It is also apparent that the first side wall 4 has a lateral opening 12, into which an actuation section 35 projects at the clamping section 11 of the clamping spring 3. A clamping point for clamping an electrical conductor formed between the clamping section 11 and the cover section 6 can be opened by an actuation tool striking on the actuation section 35 and an actuating force being applied to the clamping section 11 in the direction of the base section 7.

Figure 7:
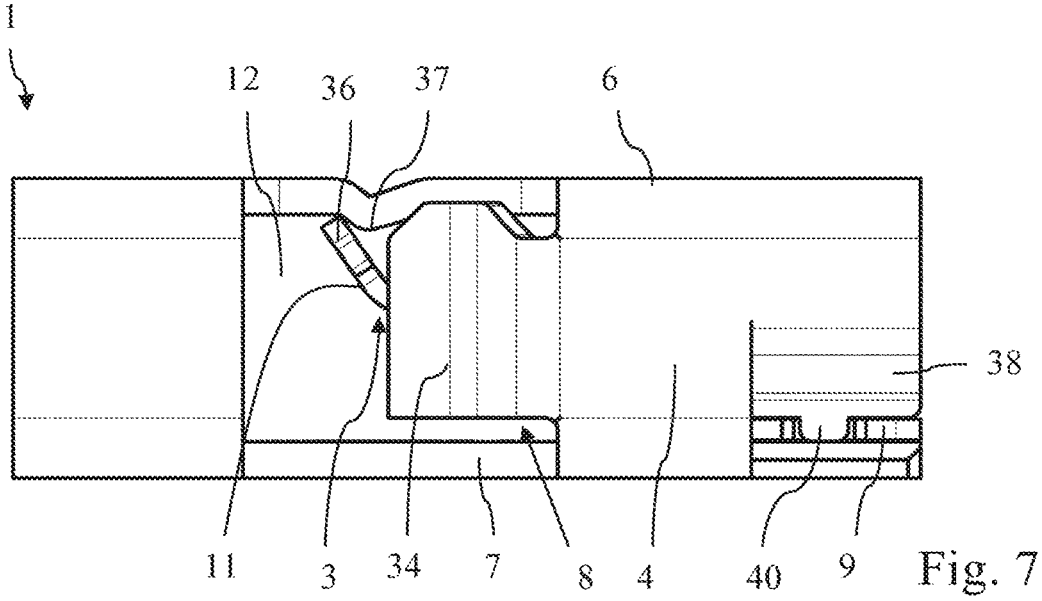
FIG. 7 is a side view of the conductor connection contact element from FIG. 6.

FIG. 7 shows a side view of the conductor connection contact element 1. It is clear that the cover section 6 in the region of the clamping edge 36 of the clamping spring 3 has a contact projection 37 at the free end of the clamping section 11. Said contact projection is formed by folding or embossing the otherwise flat cover section 6 in the direction of the base section 7. Thus, a clamping point for clamping an electrical conductor is formed between the contact projection 37 and the clamping edge 36.

It can be further seen that the material tongues 34 are cohesively formed with the side wall 4 and are inclined inwards into the conductor insertion channel 8. They point to the clamping section 11 of the clamping spring 3. The side wall 4 has an opening 12 in the area between the free end of the material tongue 34 and a rear (left in the picture) area, through which the clamping section 11 is accessible.

Figure 8:
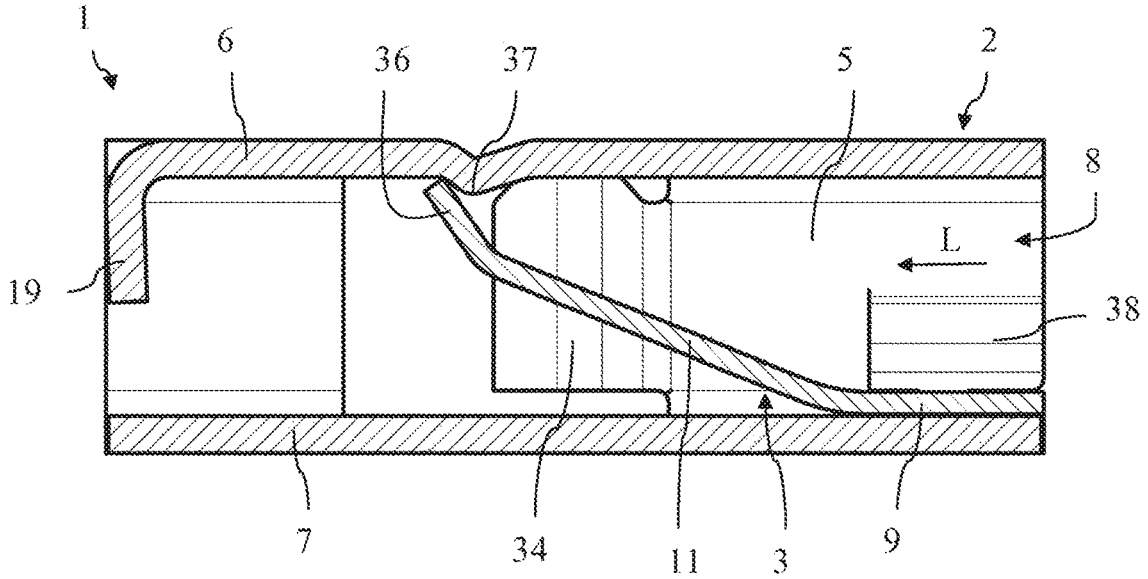
FIG. 8 is a side sectional view through the conductor connection contact element from FIG. 7.

FIG. 8 shows a side sectional view of the conductor connection contact element 1 from FIG. 7. This clearly shows once again that a contact projection 37 is formed on the cover section 6 so as to project into the interior of the power rail piece 2. In the illustrated rest state, the freely movable end of the clamping section 11 of the clamping spring 3 rests directly with its clamping edge 36 behind the clamping projection 37, without a clamped electrical conductor. The position of the clamping projection 37 is aligned with the clamping edge 36 such that when connecting an electrical conductor, the clamping force of the clamping spring 3 acting on the electrical conductor clamps the clamped electrical conductor to the clamping projection 37. The clamping force of the clamping spring 3 is thus concentrated on the clamping projection 37 and the electrical conductor, if desired, is somewhat bent over behind the clamping projection 37 in order to effect positive engagement between the electrical conductor and the clamping edge 37.

It can also be seen that, as viewed in the conductor insertion direction L (i.e., on the right side), the portion of the second side wall 5 facing the base section 7 is placed within the interior of the power rail piece 2, in order to rest on the abutment section 9 of the clamping spring 3 and clamp it to the power rail piece 2. In this respect, reference is also made to FIG. 6. A corresponding, inwardly curved mounting portion 38 is also provided on the first side wall 4.

Furthermore, it is clear that the power rail piece 2 has an end-side material tab 19 for forming an end stop which is bent down from the cover section 6 in the direction of the base section 7. An electrical conductor inserted into the conductor insertion channel 8 thus abuts end-side on said material tab 19 and cannot be guided back out.

Figure 9:
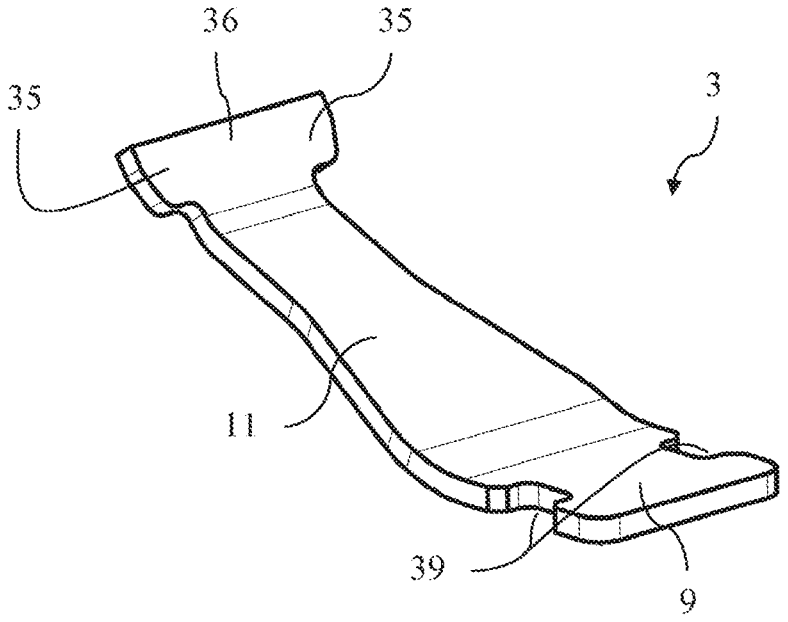
FIG. 9 is a perspective view of the clamping spring of the conductor connection contact element from FIGS. 6 to 8.

FIG. 9 reveals a perspective view of the clamping spring 3 for the second exemplary embodiment of the conductor connection contact element 1 from FIGS. 6 through 8. It is clear that the abutment section 9 has indentations 39 at its side edges. In FIGS. 6 and 7, discernible tabs 40 of the inwardly bent mounting portion 38 are inserted in these indentations 39 in order to fix the clamping spring 3 in its position on the power rail piece 2.

Further provided are the clamping edge in the central area, on the freely movable end of the clamping section 11 of the clamping spring 3, and actuation tabs 35 for the formation of actuation sections projecting from the two opposite sides of the side edge. These project as shown in FIG. 6 into the lateral opening of the respective side wall 4 and 5 and are accessible there by an actuation tool.

Furthermore, starting from the abutment section 9, the clamping section 11 initially conically tapers and then transitions back into a widening portion with the laterally projecting actuation tabs 35.

Figure 10:
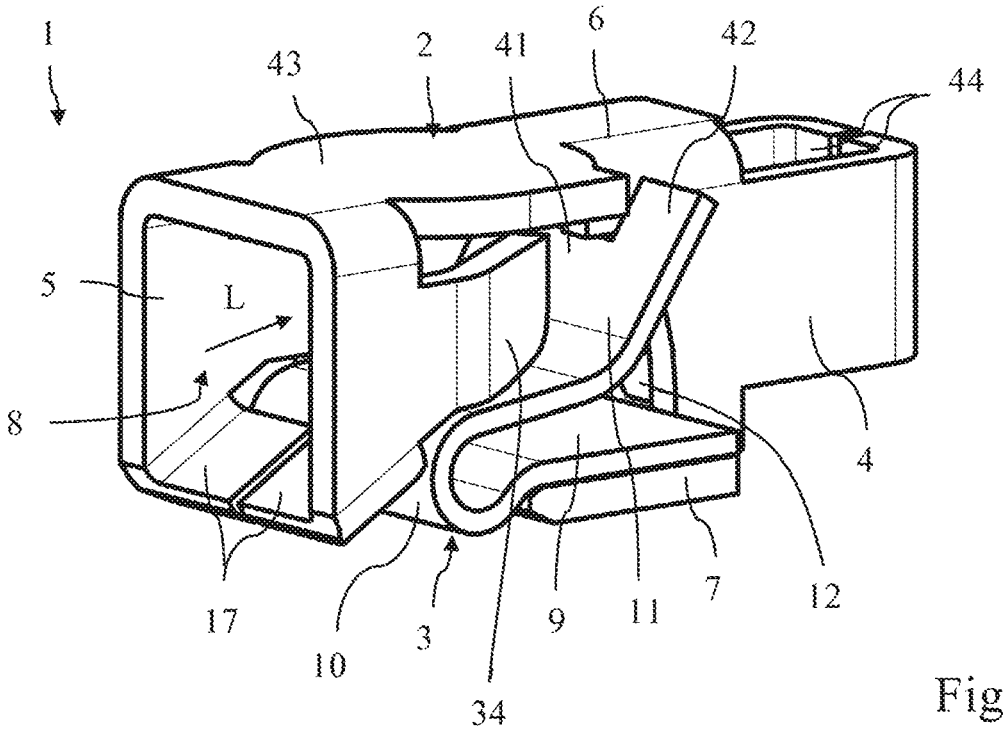
FIG. 10 is a perspective view of an embodiment of a conductor connection contact element from the first side.

FIG. 10 reveals a third embodiment of a conductor connection contact element 1, which is again formed from a power rail piece 2 and a clamping spring 3. The clamping spring 3 is formed as a U-shaped leg spring with an abutment section 9, a subsequent resilient bend 10 and a clamping section 11 adjoining the resilient bend 10. The abutment section 9 is supported on the base section 7 of the power rail piece 2.

Also in this embodiment, the power rail piece 2 is cage-shaped to border a conductor insertion channel 8 with the opposite cover and base sections 6, 7, and the first and second side walls 4, 5 laterally connecting the cover and base sections 6, 7.

A material tongue cohesively configured with the first side wall 34 is aligned from the first side wall 4 to the opposing second side wall 5 to form a conductor guide region into the interior of the conductor insertion channel 8. This material tongue 34, that is, the conductor guide region, is located between the cover section 6 and the clamping section 11 so that the clamping spring is arranged between the material tongue 34 and the base section 7.

An electrical conductor inserted from the front (the left side on the image) into the conductor insertion channel 8 is guided by means of the material tongue 34 to the clamping edge 41 of the clamping spring 3. Laterally adjacent to the clamping edge 41, an upwardly projecting actuation tab 42 is provided which extends in the direction of the plane of the cover section 6 and is disposed laterally next to the side wall 4 and the cover section 6 in the illustrated rest state.

Again, the first side wall 4 has an opening 12, through which the actuation section with the actuation tab 42 laterally project. The opening 12 is formed such that the clamping section 11 can be moved in the direction of the abutment section 9 to open a clamping point for an electrical conductor formed between the clamping edge 41 and the inner wall of the cover section 6.

The cover section 6 has a, for example, partially circular, widened handle portion 43 which provides a platform for a suction and gripping tool of an assembly robot and/or can be used as a solder connection area.

Further, the two side walls 4, 5 have in their end region facing material tongues 44 for forming an end stop. Thus, a conductor collecting pocket is provided. In the area of these conductor collecting pockets, no cover section 6 is present so that a viewing window is formed to check the insertion state of an inserted conductor.

Figure 11:
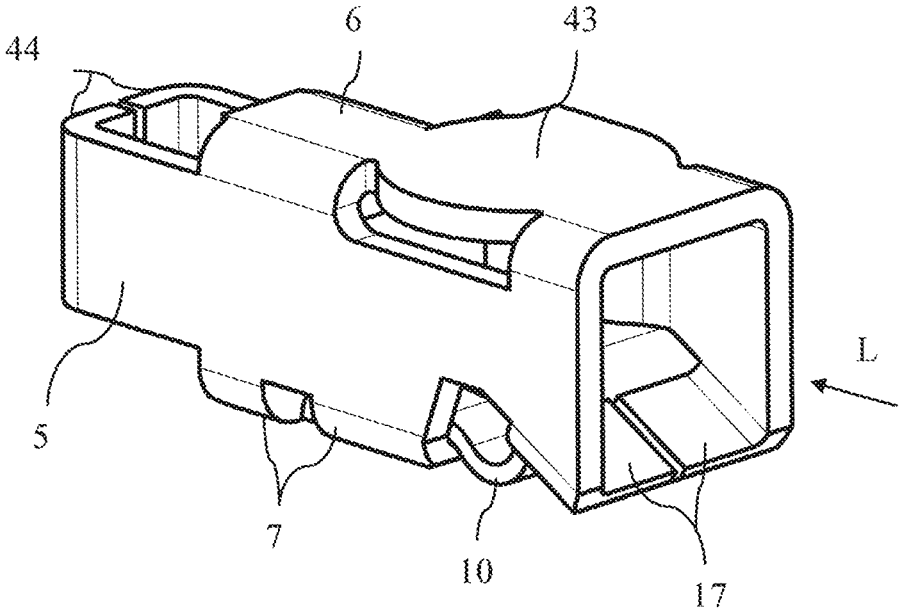
FIG. 11 is a perspective view of the conductor connection contact element from FIG. 10 from the second side.

FIG. 11 shows a perspective side view of the conductor connection contact element 1 from FIG. 10, from the opposite side with a view to the second side wall 5. Here, it can be seen that this side wall 5 has no opening and no conductor guide region, which is placed into the conductor insertion opening 8.

It can further be seen that the cover section 6 and the base section 7 are cohesively connected to the second side wall 5 by folding or bending.

In addition, as in FIG. 10, the inclined conductor guide planes are also visible, which are bent away from the two side walls 4, 5 and are upstream of the resilient bend 10. In this regard, reference is made to the first embodiment.

Figure 12:
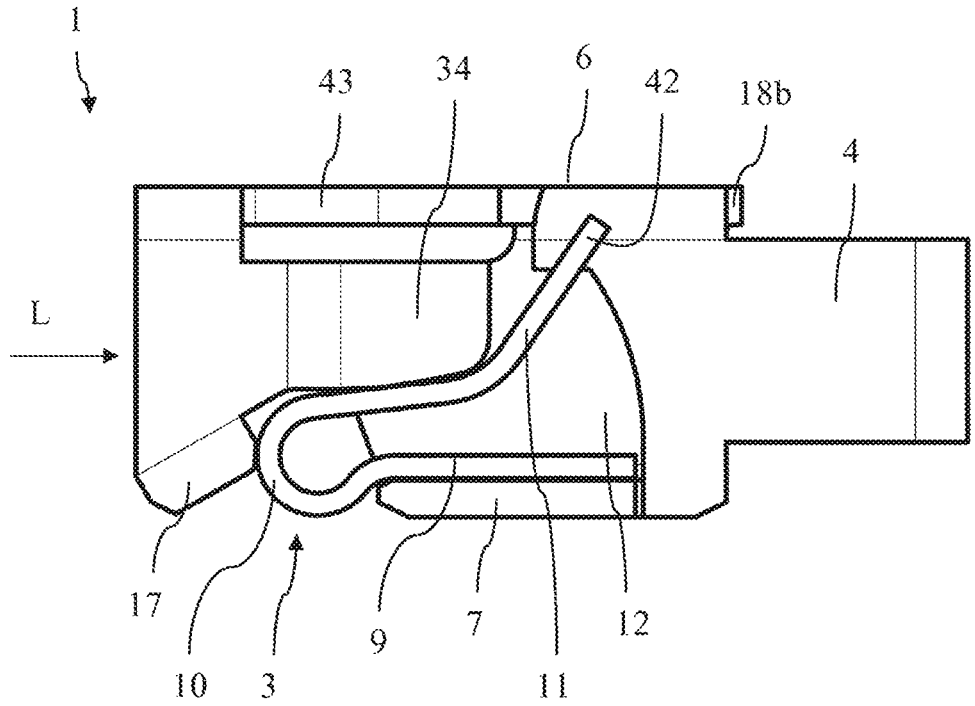
FIG. 12 is a side view of the conductor connection contact element from FIG. 10.

FIG. 12 shows a side view of the conductor connection contact element 1 from FIG. 10 with a view to the first side wall 4. It is clear that this first side wall 4 has an opening 12 through which the actuation section of the clamping spring 3 passes. The actuation tab 42 projects beyond the opening to an extent that it is positioned next to the first side wall 4 which adjoins the opening 12.

Figure 13:
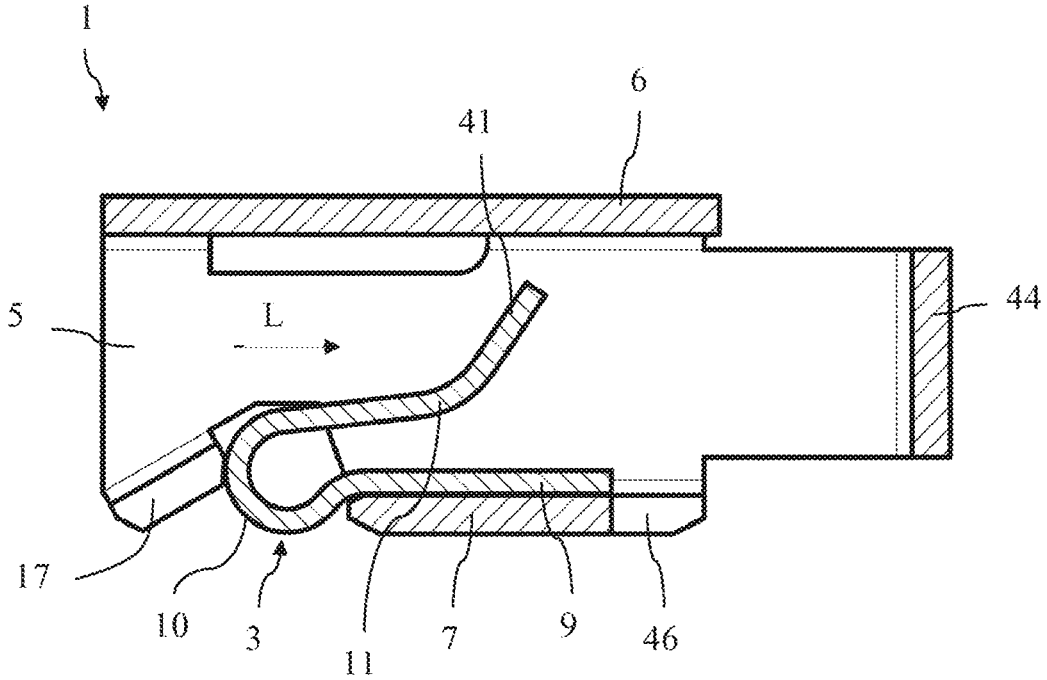
FIG. 13 is a side sectional view of the conductor connection contact element from FIG. 12.

FIG. 13 reveals a side sectional view through the conductor connection contact element 1 from FIG. 12. It is clear in this case that the base section 7 has a fixing opening 46 adjacent to the end of the abutment section 9 of the clamping spring 3.

Figure 14:
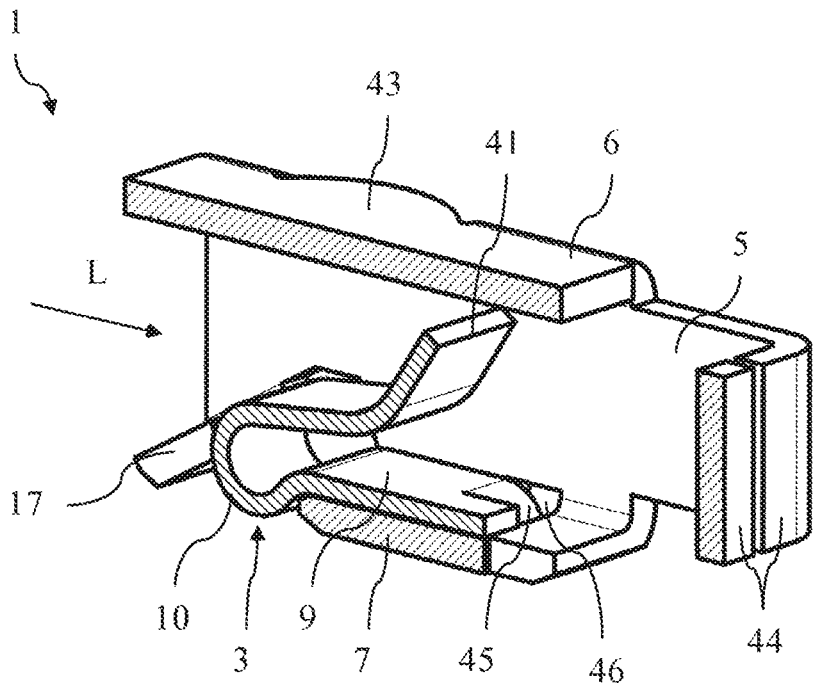
FIG. 14 is a perspective sectional view of the conductor connection contact element from FIGS. 10 to 13.

FIG. 14 shows a perspective side sectional view through the conductor connection contact element 1 from FIG. 10. It can be seen that, as in the first embodiment, an oblique conductor guide plane 17 is formed upstream of the resilient bend 10. This is integrally formed with the power rail element 2 as a material section that is bent off from at least one side wall 4, 5.

The positional fixing of the clamping spring 3 to the power rail piece 2 is achieved in this embodiment with a fixing section designed as a tab 45 on the abutment section 9. This tab 45 is inserted in a fixing opening 46 in the base section 7. Just like the clamping section 11, the abutment section 9 rests at the inside of the second side wall 5 in order to prevent a tilting or twisting.

Figure 15:
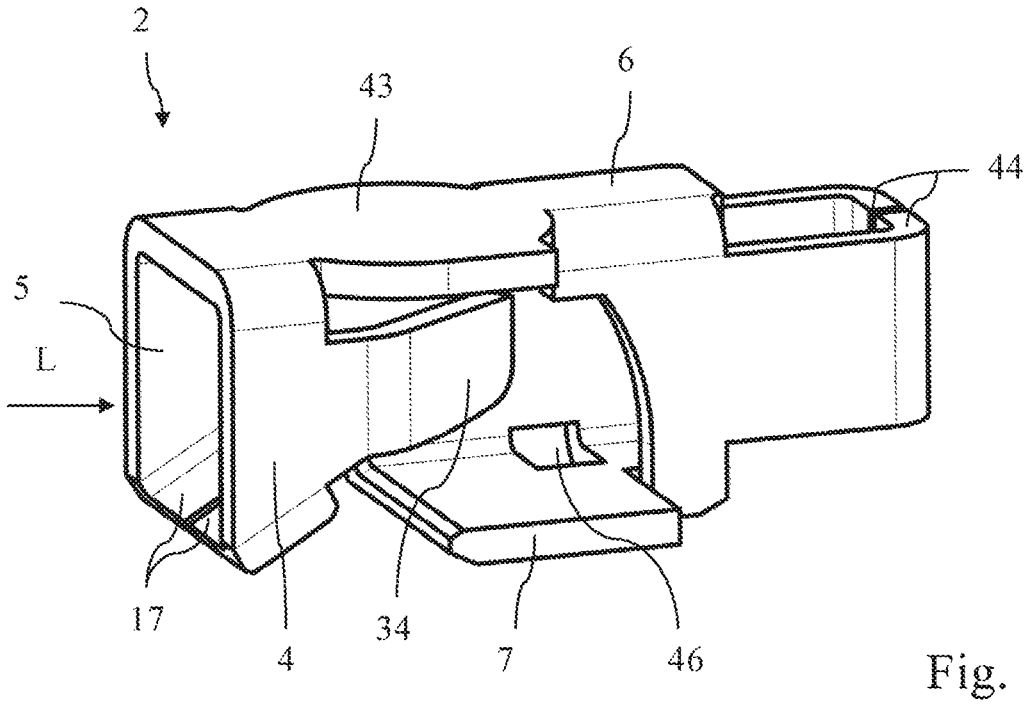
FIG. 15 is a perspective view of the power rail piece of the conductor connection contact element from FIG. 10.

FIG. 15 shows a perspective view of the power rail piece 2 of the conductor connection contact element 1 from FIG. 10. Here, again the conductor guide plane 17 is formed of two material tongues each bent from the first and second side wall 4, 5 and inclined in the direction of the cover section 6.

The base part 7 is located at a distance behind said conductor guide plane 17, as viewed in the conductor insertion direction L. The material tongue 34 forming a conductor guide region and inclined toward the second side wall 5 is arranged between the base part 7 and the cover part 6.

Figure 16:
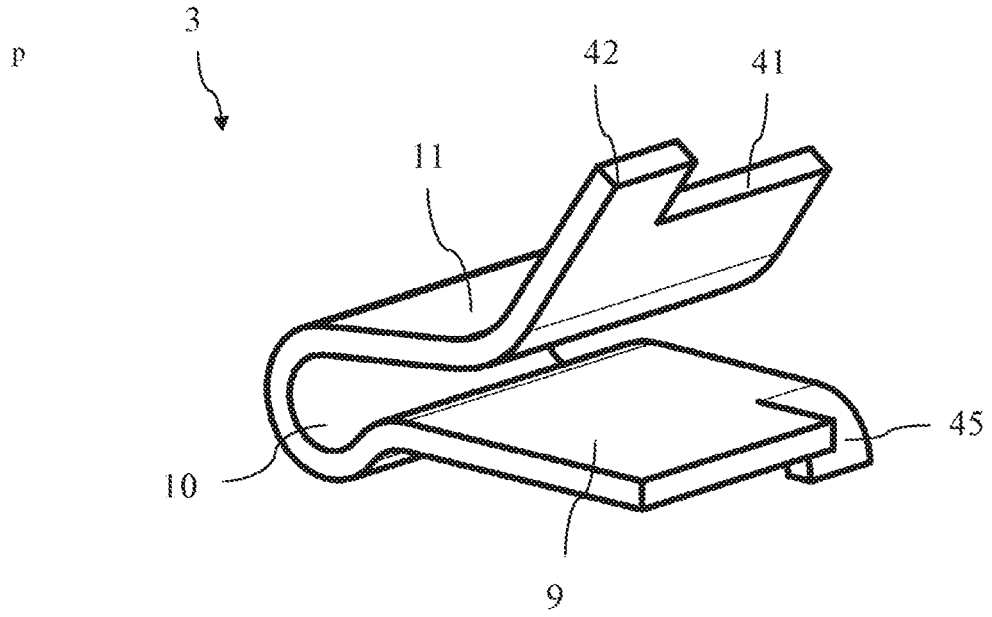
FIG. 16 is a perspective view of the clamping spring of the conductor connection contact element from FIGS. 10 to 14.

FIG. 16 shows a perspective view of the clamping spring 3 of the third exemplary embodiment from FIGS. 10 and 11 of a conductor connection contact element 1. Here, the tab 45 forming the fixing section is bent from the abutment section 9 adjacent to a side edge. This tab 45 is thus located below the clamping edge 41 of the clamping section 11 of the clamping spring 3. In this embodiment, the tab 45 is not arranged in a central area of the abutment section 9. However, this is available as an option.

It is also evident that the actuation tab 42, as viewed transversely to the longitudinal extension direction of the clamping section 11, is positioned next to the clamping edge 41 and extends beyond the end region formed by the free end region of the clamping edge 41. The actuation region is thus shifted upward, that is, in the direction of the cover section 6 and away from the base section 7.

Figure 17:
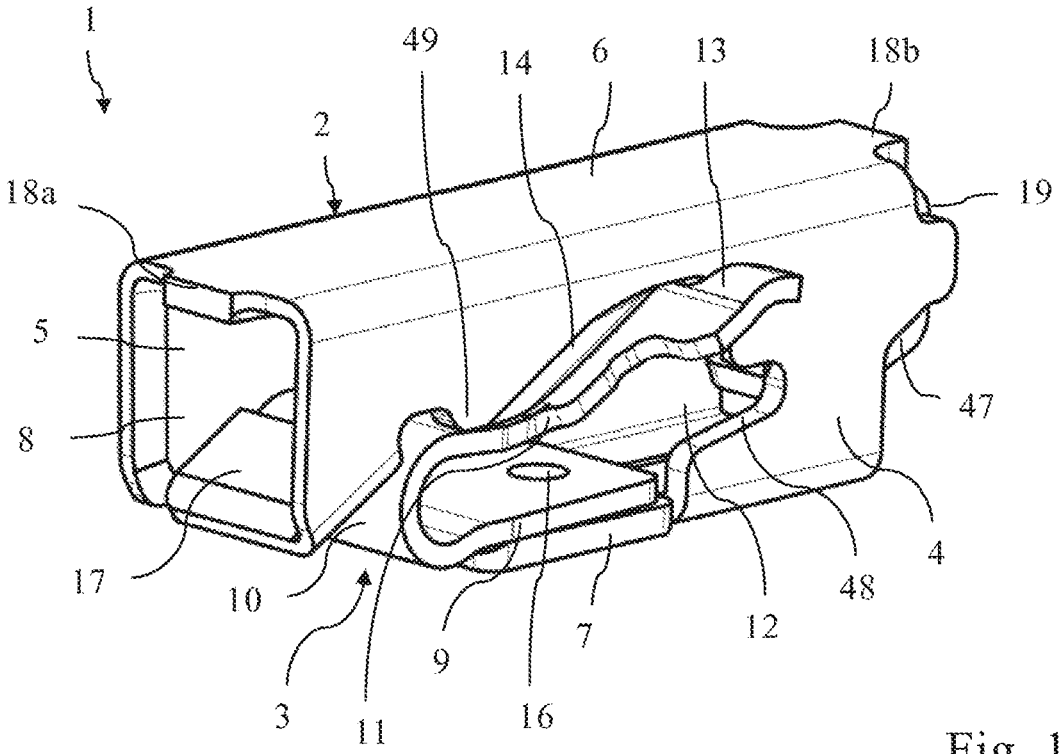
FIG. 17 is a perspective view of an embodiment of a conductor connection contact element.

FIG. 17 shows a perspective view of a fourth embodiment of a conductor connection contact element 1. This is substantially a version of the first embodiment, modified in detail, so that essentially reference can be made to the description of FIGS. 1 to 5.

In this case, the above-mentioned alternative is realized in a conductor guide plane 17 projecting from the side wall 4 toward the opposite side wall 5.

In this embodiment, the end stop 19 is bent from the second side wall 5 in the direction of the first side wall 4, and has a guide surface 47 in this transversely extending section, which projects in the direction of the base section 7. Thus, a conical or funnel-shaped, tapered conductor collecting pocket is provided.

The overload stop tab 15 provided in the first embodiment is absent in this embodiment. An overload stop is provided at a suitable height by means of the bottom peripheral edge 48 of the first side wall 4 which borders the opening 12.

Furthermore, a support surface 49 is provided by the first side wall 4 in the area situated in the region adjacent to the conductor guide region 14 and between the conductor guide region 14 and the conductor guide plane 17, on which the clamping spring 3 rests in the illustrated rest state to stabilize the position. In the illustrated version, the clamping section 11 of the clamping spring 3 rests just behind the resilient bend 10 on the support surface 49 formed as an arc of the side wall 4.

Figure 18:
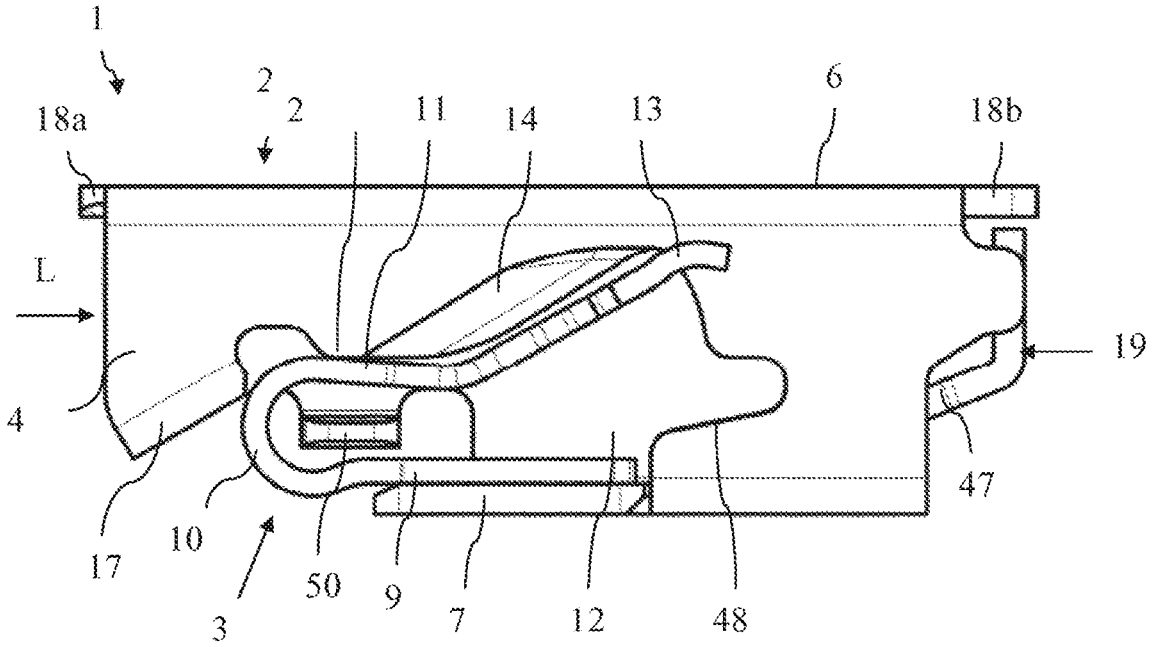
FIG. 18 is a side view of the conductor connection contact element from FIG. 17.

FIG. 18 reveals a side view of the conductor connection contact element 1 from FIG. 17. Here, it is again clear that the support surface 49 is designed as an area immediately adjoining the conductor guide region 14, which transitions into a subsequent inlet formed by an arc-like contour up to the conductor guide plane 17.

FIGS. 17 and 18 also show that the actuation tab 13 further extends toward the cover section 6 and again curves slightly downward back toward the base section 7. The actuation tab 13 is then arranged with a part of its length adjacent to the side wall 4, thus extending beyond the opening 12. The actuation tab 13 is thus substantially extended in comparison to the first embodiment.

Furthermore, an arbor 50 projects from the second side wall 5 in the direction of the opening 12 or the plane of the first side wall 4. This arbor 50 is disposed adjacent to the resilient bend 10 of the clamping spring 3 so that the arbor 50 is positioned between the clamping section 11 and the abutment section 9 in the region of the resilient bend or the spring root.

Figure 19:
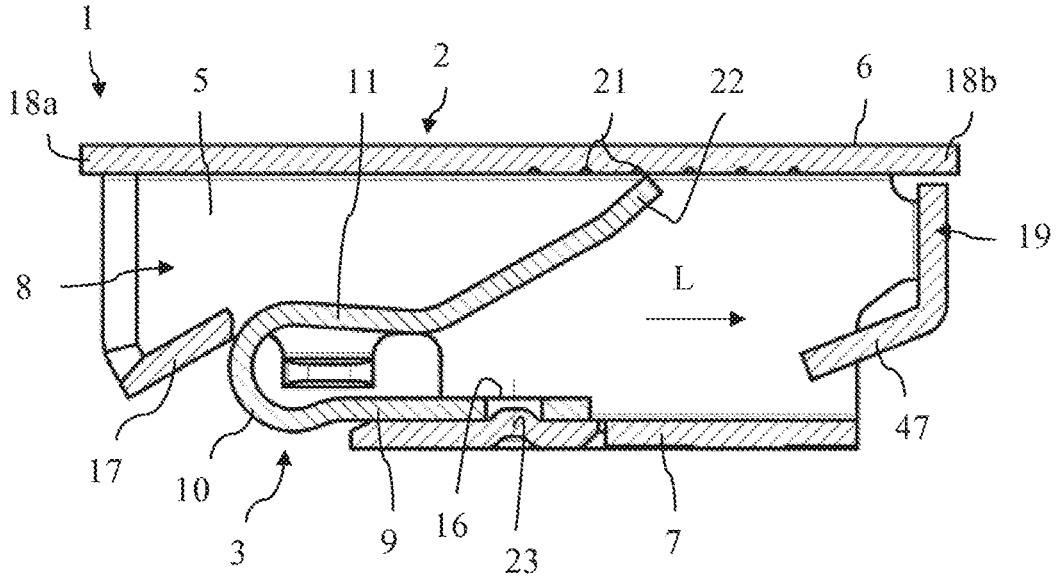
FIG. 19 is a side sectional view of the conductor connection contact element from FIG. 18.

FIG. 19 shows a side sectional view of the conductor connection contact element 1 from FIG. 18. Here, the arbor 50 is dearer, which is positioned in the resilient bend 10 between the adjoining clamping section 11 and the abutment section 9.

Also apparent is the conductor collecting pocket with the end stop 19 and the guide section 47 which is oriented opposite the conductor insertion direction L in the direction of the base section 7.

It is also evident that the freely movable end of the clamping section 11, on which the clamping edge 22 is formed, is slightly bent toward the cover section 6 so that the clamping section 11, starting from the resilient bend 10, is oriented at a first acute angle to the cover section 6 after a first bend and is aligned in its end region at a second acute angle to the cover section 6. The second acute angle is greater than the first acute angle.

Figure 20:
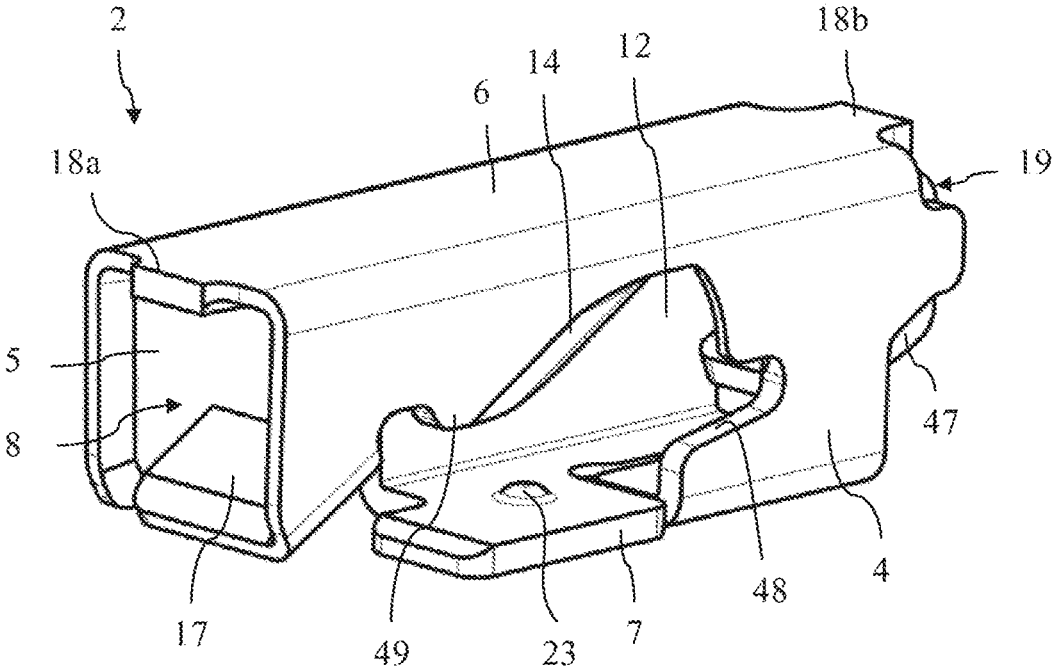
FIG. 20 is a perspective view of the power rail piece of the conductor connection contact element from FIG. 17.

FIG. 20 shows a perspective view of the power rail piece 2. Reference can substantially be made to the description of FIG. 4. It is clear that on the first side wall 4, a peripheral edge 48 is available opposite the opening 12 toward the conductor insertion section 14, which borders the opening 12 toward the base section 7 and can be used as an overload stop.

It is also apparent that in partial regions, the base section 7 is formed from sheet metal sections folded from the second side wall 5 and on the other hand, formed from sheet metal sections folded from the first side wall 4, which are adjacent to each other.

Figure 21:
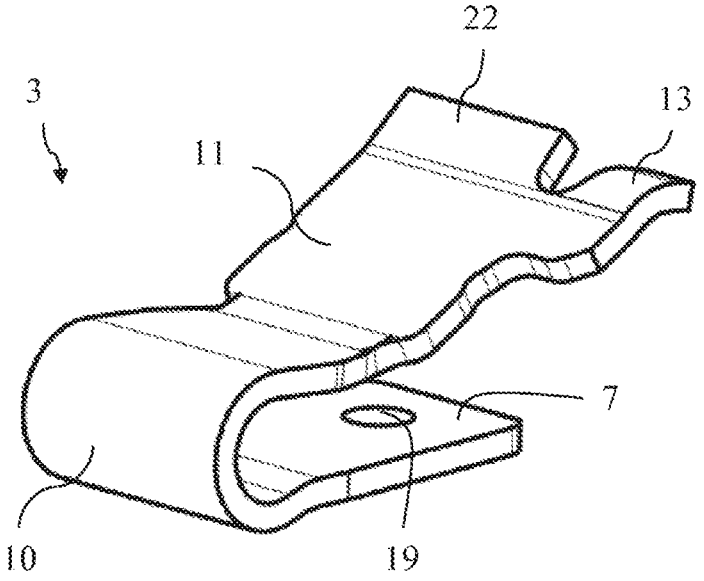
FIG. 21 is a perspective view of the clamping spring of the conductor connection contact element from FIGS. 17 to 19.

FIG. 21 shows a perspective view of the clamping spring 3 for the conductor connection contact element 1 from FIGS. 17 to 19. Here, it is again clear that the actuation tab 13 is arranged on the clamping section 1, laterally next to the clamping edge 22. The actuation tabs 13 are thereby separate from the clamping edge 22 and are bent with a curved contour slightly downward in the direction of the plane of the abutment section 7.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection contact element for clamping an electrical conductor, the conductor connection contact element comprising:

a first side wall;

a second side wall arranged opposite the first side wall;

a base section extending from the first side wall towards the opposing second side wall;

a cover section arranged opposite the base section and extending from the first side wall towards the second side wall, the first side wall and the second side wall bordering a conductor insertion channel with the base section and the cover section, wherein the first side wall, the second side wall, the base section, and the cover section being formed from one sheet metal part, and wherein the first side wall, the second side wall, the base section and the cover section form a power rail piece; and a clamping spring arranged on the power rail piece, the clamping spring having an abutment section on a first end region and a clamping section on a second end region, which is opposite the first end region, the clamping section having a clamping edge for clamping the electrical conductor, wherein the abutment section is arranged on the base section, wherein a freely movable end of the clamping section extends towards the cover section, wherein the first side wall has an opening, and wherein the clamping spring with its abutment section, the clamping section and a resilient bend, which connects the abutment section with the clamping section, projects into the opening.

2. A conductor connection contact element according to claim 1, wherein the clamping spring has an actuation section, and wherein the actuation section is an actuation tab arranged laterally on the clamping section of the clamping spring and laterally projects through the opening from the first side wall.

3. A conductor connection contact element according to claim 1, wherein a conductor guide region is oriented facing away from the end edge of the first side wall bordering the opening, which opposes the conductor guide region.

4. A conductor connection contact element for clamping an electrical conductor, the conductor connection contact element comprising:

a first side wall; and a second side wall arranged opposite the first side wall;

a base section extending from the first side wall towards the opposing second side wall; and a cover section arranged opposite the base section and extending from the first side wall to the opposing second side wall, the first side wall and the second side wall bordering a conductor insertion channel with the base section and the cover section, wherein the first side wall, the second side wall, the base section and the cover section form a power rail piece; and a clamping spring arranged on the power rail piece, which at a first end region has an abutment section and at a second end region opposite to the first end region has a clamping section with a clamping edge for clamping the electrical conductor, wherein the abutment section is arranged on a base section, wherein a freely movable end of the clamping section extends towards the cover section, wherein the first side wall has an opening, and wherein the opening has a size that includes the abutment section of the clamping spring and a resilient bend of the clamping spring formed from the abutment section to the clamping section.

5. A conductor connection contact element according to claim 4, wherein the opening is bordered by edges of the first side wall and a base section abutting the side wall.

* * * * *